US007137233B2

(12) United States Patent
DeGrasse et al.

(10) Patent No.: US 7,137,233 B2
(45) Date of Patent: Nov. 21, 2006

(54) METHOD AND APPARATUS FOR WRAPPING A LOAD

(75) Inventors: Steven E. DeGrasse, New Albany, IN (US); Patrick R. Lancaster, III, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 125 days.

(21) Appl. No.: 09/985,156

(22) Filed: Nov. 1, 2001

(65) Prior Publication Data

US 2002/0056253 A1 May 16, 2002

Related U.S. Application Data

(60) Provisional application No. 60/244,900, filed on Nov. 2, 2000.

(51) Int. Cl.

| | |
|---|---|
| ***B65B 13/02*** | (2006.01) |
| ***B65B 53/00*** | (2006.01) |
| ***B65B 13/00*** | (2006.01) |

(52) U.S. Cl. ..... 53/399; 53/587; 53/441; 53/556

(58) Field of Classification Search ..... 53/399, 53/411, 414, 436, 441, 438, 528, 556, 587, 53/589, 523; 198/364, 468.01, 468.11, 468.9, 198/736, 739; 414/223.01

See application file for complete search history.

(56) References Cited

U.S. PATENT DOCUMENTS

| | | | | |
|---|---|---|---|---|
| 2,962,163 A | * | 11/1960 | Thompson | 206/322 |
| 3,453,167 A | * | 7/1969 | Arvidson et al. | 156/360 |
| 3,514,920 A | | 6/1970 | Hofffler et al. | 53/61 |
| 3,589,102 A | | 6/1971 | Zenick | 53/557 |

(Continued)

FOREIGN PATENT DOCUMENTS

| | | |
|---|---|---|
| DE | 36 15 450 A1 | 11/1987 |
| EP | 0 086 045 A2 | 8/1983 |
| EP | 0 086 045 | 1/1993 |
| EP | 0 849 175 A2 | 6/1998 |

*Primary Examiner*—Stephen F. Gerrity
*Assistant Examiner*—Paul Durand
(74) *Attorney, Agent, or Firm*—Finnegan, Henderson, Farabow, Garrett & Dunner, L.L.P.

(57) ABSTRACT

An apparatus and method for wrapping a palletized load is provided. The apparatus includes a non-powered conveyor load wrapping surface, at least one non-powered conveyor load storage surface, and a pusher assembly for moving the load between the wrapping and storage surfaces. The non-powered conveyor load wrapping surface is provided on a surface of a rotatable turntable and is isolated from any electrical or fluid power source by the rotatable turntable. The pusher assembly includes at least one pusher arm rotatable between an upright home position and a horizontal pushing position. The apparatus may also include a load building surface in a hand palletizing area. Hand palletized loads are pushed from the load building surface onto either a load storage surface or the load wrapping surface.

59 Claims, 18 Drawing Sheets

U.S. PATENT DOCUMENTS 3,867,806 A 2/1975 Lancaster et al. ..... 53/441
3,977,158 A 8/1976 Jennings et al. ..... 53/226
3,989,094 A 11/1976 Gorenflo et al. ..... 164/324
4,036,364 A 7/1977 Ambrose ..... 206/526
4,077,179 A * 3/1978 Lancaster et al. ..... 53/441
4,152,879 A * 5/1979 Shulman ..... 53/399
4,283,903 A * 8/1981 Mayhall et al. ..... 53/587
4,598,534 A 7/1986 Rosenthal et al.
4,641,484 A * 2/1987 Popelka ..... 53/399
4,995,224 A * 2/1991 Yourgalite et al. ..... 53/540
5,006,336 A 4/1991 Payne
5,020,300 A * 6/1991 Casteel ..... 53/399
5,046,303 A 9/1991 Becicka et al.
5,107,657 A * 4/1992 Diehl et al. ..... 53/141
5,117,961 A * 6/1992 Nicholson ..... 198/369.5
5,217,174 A * 6/1993 Martin et al. ..... 241/222
5,445,493 A * 8/1995 Yourgalite et al. ..... 414/791.6
5,447,008 A * 9/1995 Martin-Cocher ..... 53/399
5,489,185 A * 2/1996 Reichert ..... 414/795.9
5,758,471 A * 6/1998 Denley et al. ..... 53/399
5,893,258 A * 4/1999 Lancaster, III ..... 53/399
5,911,666 A * 6/1999 Lancaster et al. ..... 53/492
3,170,228 A1 1/2001 Zeman, III ..... 53/74
6,729,754 B1 * 5/2004 Midas ..... 366/208
6,775,956 B1 * 8/2004 Lacey ..... 53/399

* cited by examiner

METHOD AND APPARATUS FOR WRAPPING A LOAD

This application claims the right to priority based on Provisional Patent Application No. 60/244,900 filed Nov. 2, 2000, and entitled "Method and Apparatus for Wrapping a Load," the entire contents of which is incorporated herein by reference.

BACKGROUND OF THE INVENTION

1. Field of the Invention

The invention relates to wrapping a load with packaging material, and, more particularly, to stretch wrapping.

2. Description of the Prior Art

Various packaging techniques have been used to build a load of unit products and subsequently wrap them for transportation, storage, containment and stabilization, protection and waterproofing. One system uses stretch wrapping machines to stretch, dispense, and wrap stretch packaging material around a load. Stretch wrapping can be performed as an inline automated packaging technique which dispenses and wraps packaging material in a stretched condition around a load on a pallet to cover and contain the load. Pallet stretch wrapping, whether accomplished by turntable, rotating arm, or rotating ring typically covers the four vertical sides of the load with a stretchable film such as polyethylene film. In each of these arrangements, relative rotation is provided between the load and a packaging material dispenser to wrap packaging material about the sides of the load.

Conventionally, fork trucks were used to deliver loads to and remove loads from a wrapping area. The fork truck would bring an unwrapped load to a wrapping area, set the unwrapped load aside, remove a wrapped load from a wrapping station and set it aside, place the unwrapped load on the wrapping station, initiate the wrapping sequence, and pick up and remove the wrapped load from the wrapping area. Such a process requires multiple handling of each load, a large amount of maneuvering on the part of the fork truck, and requires the fork truck driver to exit the fork truck in order to initiate the wrapping sequence. Alternatively, more than one fork truck was used to deliver and remove the loads from the wrapping station. However, use of more than one truck led to inefficiency.

Conveyorized wrapping apparatus have been used to reduce fork truck usage during the wrapping process. Powered conveyors may be used to deliver and remove a load from a wrapping station. Such powered conveyors require a large amount of space and are expensive to build and maintain. Powered conveyors mounted on turntables have been used to eliminate multiple handling of the load. However, such devices are mechanically complex and therefore are costly to maintain. In addition, such devices generally require an electrical or pneumatic transfer device under the turntable to effectuate transfer from the wrapping station, which increases the cost and complexity of the device. Dual turntables without conveyors have also been used to provide dual wrapping stations, however, problems with material handling interfaces and synchronizing of the infeed and outfeed flow exist. Finally, non-powered conveyors on turntables have been used, but such conveyors require the operator to push the load along the conveyor surface, leading to safety and stress problems.

In light of these drawbacks, there is a need to move the load to and from a wrapping station in a simple, reliable, and inexpensive manner.

SUMMARY OF THE INVENTION

Accordingly, the present invention is directed to a method and apparatus for wrapping a palletized load with packaging material which provides advantages and obviates a number of problems in earlier methods and apparatus for wrapping a load.

To achieve the advantages and in accordance with the purpose of the invention, as embodied and broadly described, one aspect of the invention includes a method of wrapping a palletized load with packaging material, including placing a palletized load to be wrapped onto a non-powered conveyor load wrapping surface of a rotatable turntable, the non-powered conveyor load wrapping surface being isolated from any electrical or fluid power source by the rotatable turntable, dispensing packaging material from a packaging material dispenser and rotating the turntable to wrap packaging material around sides of the load, and pushing the wrapped load from the non-powered conveyor load wrapping surface of the rotatable turntable to a non-driven conveyor load storage surface adjacent the non-powered wrapping surface.

According to another aspect of the invention, a method of wrapping a palletized load includes building a palletized load to be wrapped on a non-driven conveyor load building surface, pushing the load from the non-driven conveyor load building surface to a non-powered conveyor load wrapping surface of a rotatable turntable, the non-powered conveyor load wrapping surface being isolated from any electrical or fluid power source by the rotatable turntable, dispensing packaging material from a packaging material dispenser and rotating the turntable to wrap packaging material around sides of the load, and removing the wrapped load from the non-powered conveyor load wrapping surface.

According to yet another aspect of the invention, an apparatus for wrapping a palletized load is provided. The apparatus includes a dispenser for dispensing packaging material, a rotatable turntable for providing relative rotation between the dispenser and the load to wrap packaging material around the load, a non-powered conveyor load wrapping surface on the rotatable turntable being isolated from any electrical or fluid power source by the rotatable turntable, at least one non-powered conveyor load storage surface for storing the load prior and subsequent to wrapping, and a pusher assembly for pushing the load between the non-powered conveyor load wrapping surface and the at least one non-powered conveyor load storage surface.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
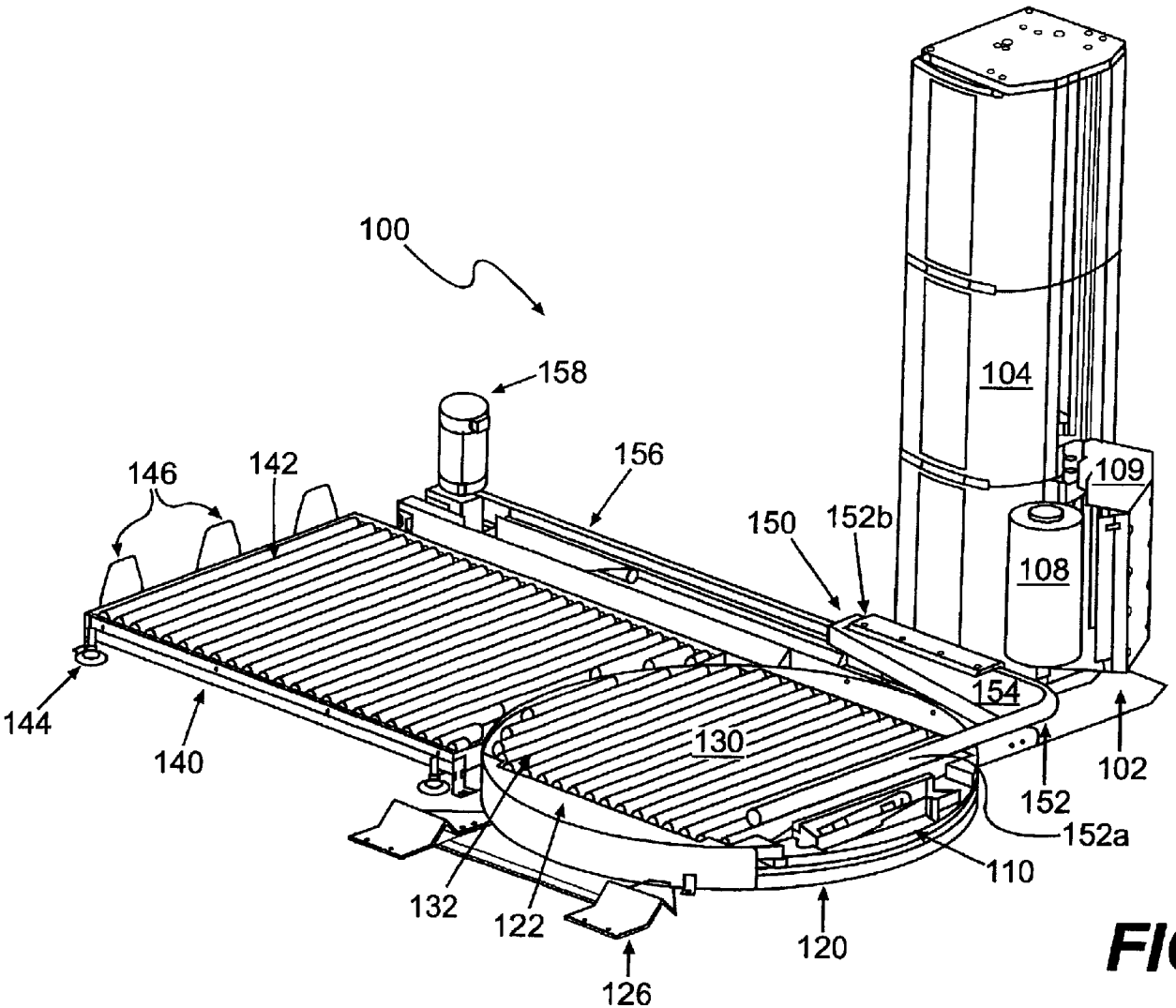
FIG. 1 is an isometric view of an embodiment of the wrapping apparatus according to the present invention.

As embodied herein and shown in FIG. 1, an apparatus for wrapping a palletized load with packaging material is generally designated by the reference numeral 100 and includes a packaging material dispenser, means for providing relative rotation between a load and the dispenser, a load wrapping surface, at least one load storage surface, and a load pusher assembly for moving the load between the wrapping surface and the storage surface.

As shown in FIG. 1, a dispenser 102 is provided for dispensing packaging material. Packaging material dispenser 102 dispenses a sheet of packaging material 116 in a web form and includes a roll carriage 109 that supports a roll of packaging material 108. Roll carriage 109 of dispenser 102 is mounted on and vertically moveable on a mast 104, shown in FIGS. 1 and 2, to dispense packaging material 116 spirally about load 124 as rotation is provided between load 124 and dispenser 102. Roll carriage 109, as embodied herein and shown in FIG. 1, includes a support for packaging material roll 108 and means for moving on mast 104. Alternatively, roll carriage 109 may include a container for holding packaging material roll 108, and a slit for dispensing packaging material 116 from packaging material roll 108.

In a preferred embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well. Dispenser 102 may also include a variety of rollers, optionally including prestretch rollers for stretching the packaging material longitudinally and/or transversely, to position, dispense, and stretch the packaging material as packaging material 116 is being dispensed from the roll of packaging material.

In the present invention, apparatus 100 includes means for providing relative rotation between the dispenser and the load to wrap packaging material around the load. As embodied herein and shown in FIGS. 1 and 2, the means for providing relative rotation include a conventional turntable assembly 120 having a rotatable turntable 122. Load 124 is rotated by rotatable turntable 122 of turntable assembly 120 to provide relative motion between dispenser 102 and load 124.

Figure 2:
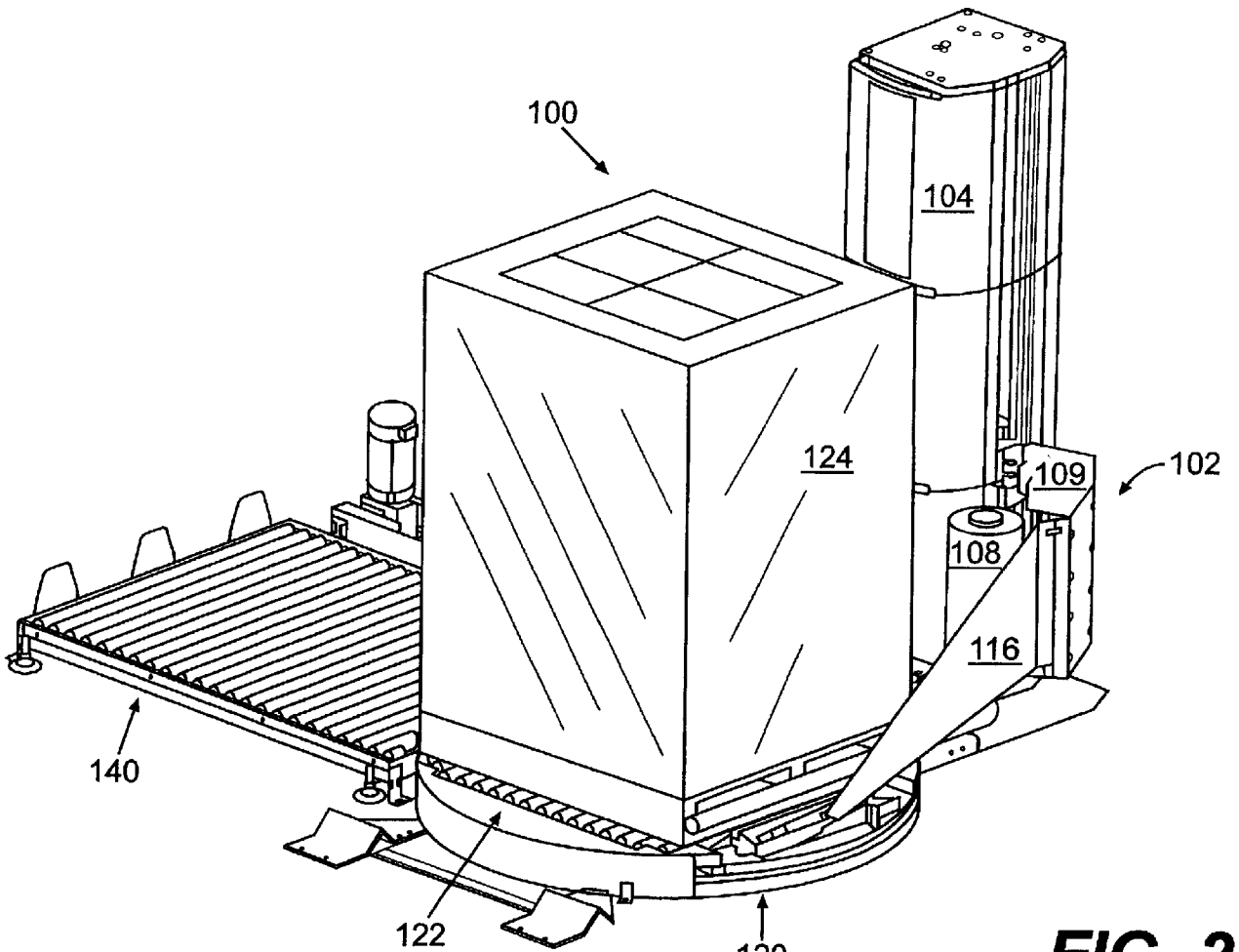
FIG. 2 is an isometric view of the apparatus of FIG. 1 with a palletized load in the wrapping position.

As shown in FIGS. 1 and 2, turntable assembly 120 includes a non-powered upper conveyor surface with a plurality of non-powered rollers for supporting the load during wrapping. As embodied herein, non-powered conveyor load wrapping surface 130 is isolated from any electrical or fluid source of power by the turntable, in contrast to conventional devices in which the rollers are powered and are connected to an electrical or fluid source of power by the turntable such as by a power connection through the journal of the turntable to the conveyor rollers. This means that the non-powered conveyor load wrapping surface 130 also does not receive any electrical or fluid power from brushes, or the like, around a circumference of the turntable. The rotatable turntable 122 therefore does not carry electrical or fluid power sources with it during rotation and acts as a barrier between the non-powered conveyor load wrapping surface 130 and any electrical or fluid source of power.

Alternatively, instead of non-powered rollers 132, the non-powered conveyor load wrapping surface 130 may use drag chains, belts, transfer ball bearings, or other non-powered, low friction elements such as a smooth surface.

The non-powered rollers 132 of the conveyor load wrapping surface 130 are preferably capable of being locked into a non-rolling position during wrapping. That is, when the load 124 is being wrapped, the non-powered rollers 132 of the load wrapping surface do not move, reducing the chance that the load 124 will shift during wrapping. Prior and subsequent to the wrapping cycle, the non-powered rollers 132 of the conveyor load wrapping surface 130 are preferably in an "unlocked" or rolling position. Thus, the rollers 132 are capable of rolling to assist in moving a load onto or off of the non-powered conveyor load wrapping surface 130. Alternatively, tabs or pins can be used, projecting through the rollers 132, to prevent travel of the load.

Such a locking device for the non-powered conveyor load wrapping surface 130 may be engaged or disengaged by various unpowered actuation processes, such as centrifugal force, by relative movement of the pusher arm 152 over the wrapping surface 130, or by a mechanical actuator.

Preferably, rotatable turntable 122 further includes a packaging material holder assembly 110 for holding a leading end of the packaging material during wrapping of the load. The packaging material holder assembly 110 is preferably positioned at an end of the load wrapping surface 130 opposite the end adjacent to a load storage surface 140, as described below. Alternatively, instead of a packaging material assembly 110, a clamp or other means may be used to restrain the leading end of the packaging material during wrapping.

Positioned proximate to turntable assembly 120 is a conveyor load storage surface 140 including non-driven rollers 142, as shown in FIGS. 1 and 2. Load storage surface 140 is preferably at the same height as the non-powered conveyor load wrapping surface 130, as shown in FIG. 1, in order to facilitate movement of a load between the wrapping surface 130 and the storage surface 140. This may be accomplished by raising load storage surface 140 on leveling feet 144, as shown in FIG. 1, or by any other suitable means. An end of the load storage surface 140 opposite the end adjacent the load wrapping surface 130 preferably includes a pallet stop element 146 for stopping the load. The pallet stop element 146 is preferably configured to allow tines of a fork truck access to the palletized load when the load is on the load storage surface 140.

Figure 9A:
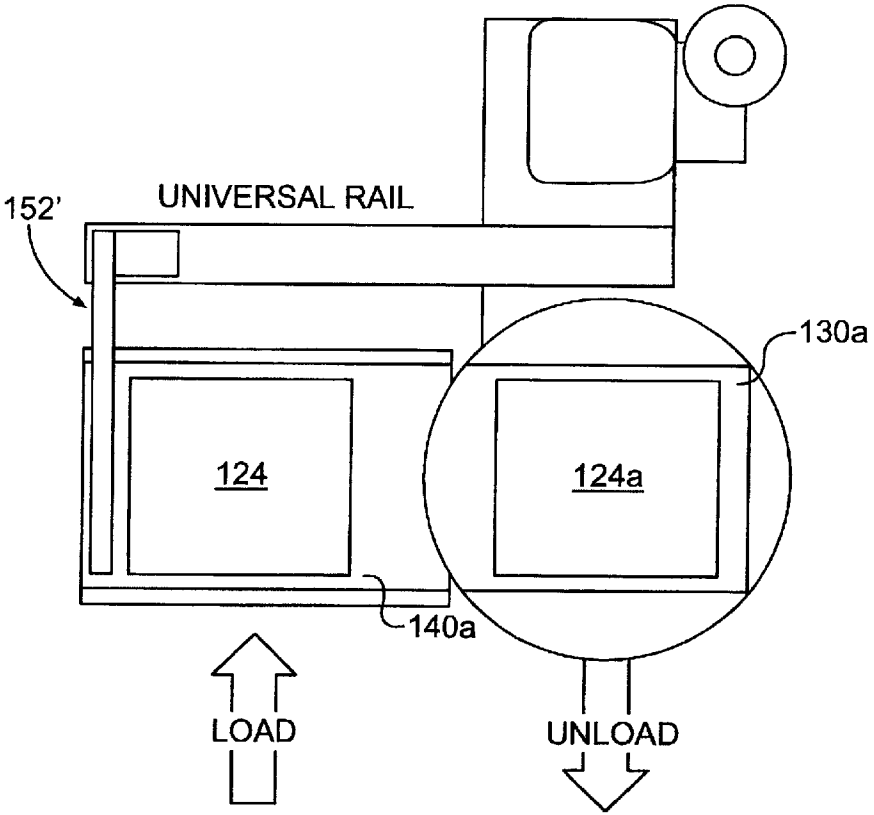
FIGS. 9A–9C are top views of alternative embodiments of the wrapping apparatus showing various wrapping and storage surface configurations.
Figure 9B:
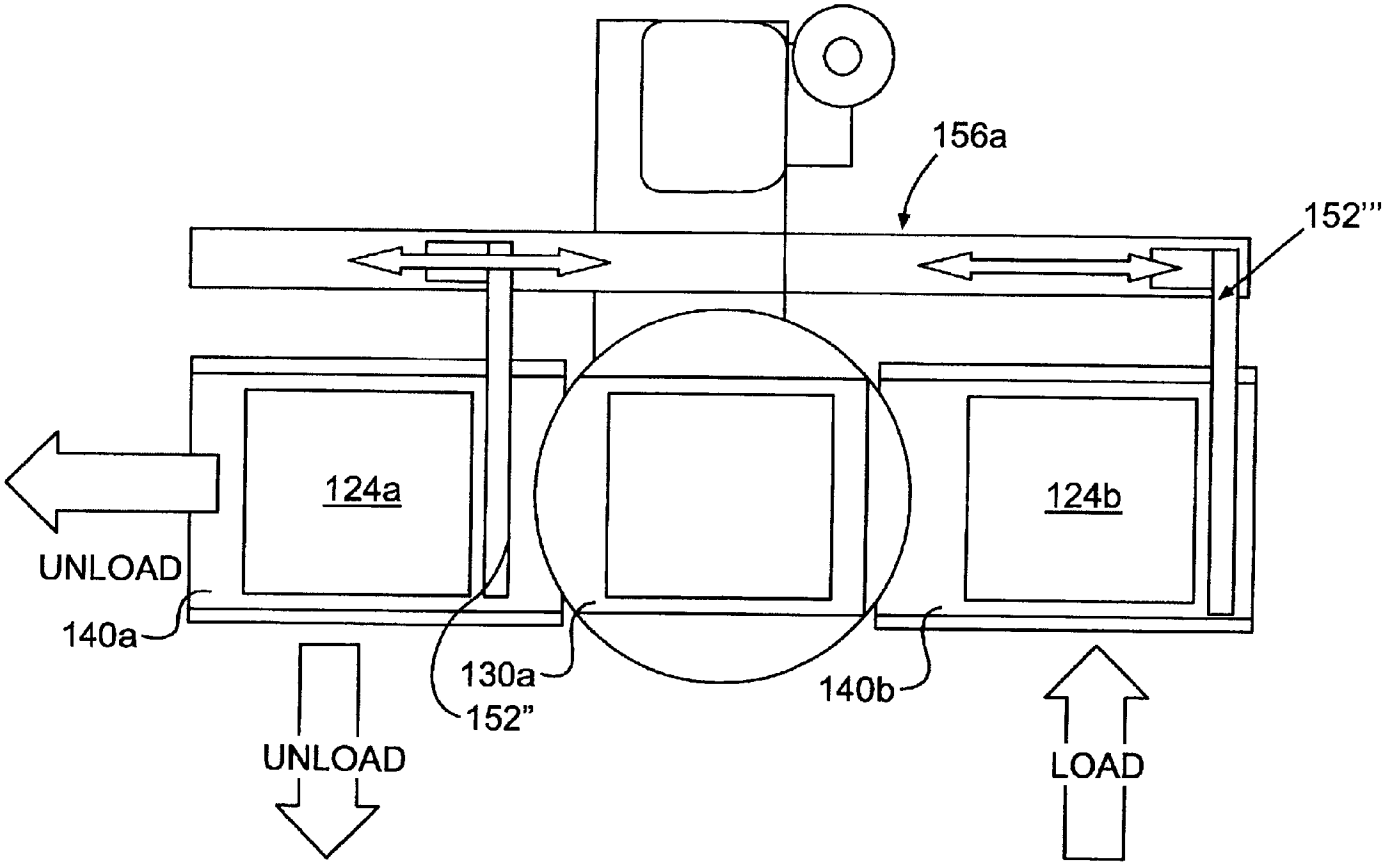
Figure 9C:
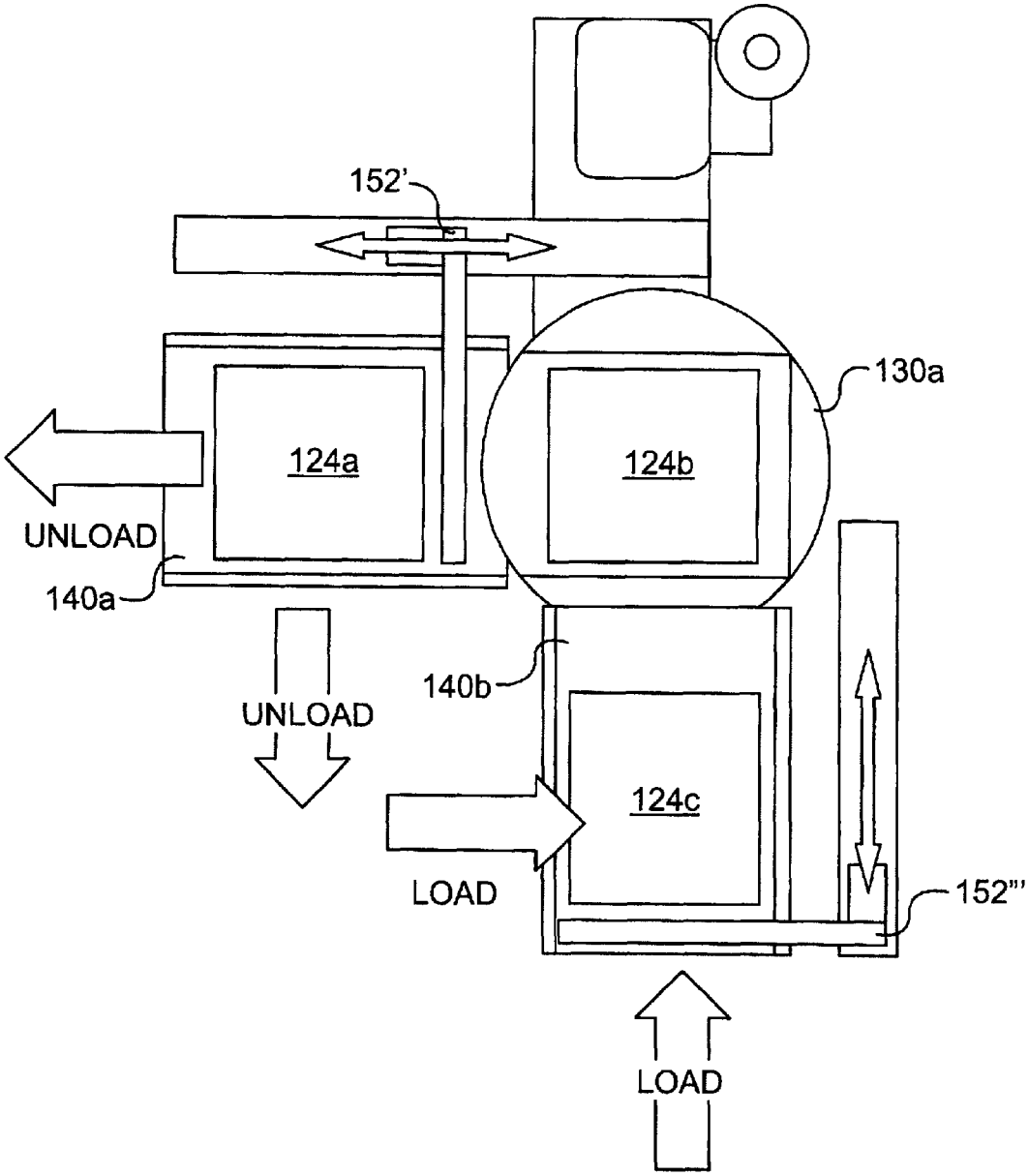

As shown in FIGS. 9A–9C, more than one conveyor load storage surface 140*a*, 140*b* may be provided. In such a case, a first storage surface 140*b* would serve as a storage surface for the unwrapped load 124*b* and a second storage surface 140*a* would serve as a storage surface for the wrapped load 124*a*. As also shown in FIG. 9B, when more than one storage surface 140*a*, 140*b* is used, a storage surface is placed on either side of turntable assembly 120. Alternatively, as shown in FIG. 9C, the storage surfaces 140*a*, 140*b* may be substantially perpendicular to one another.

According to another aspect of the invention, wrapping apparatus 100 is provided with at least one hand palletizing area for building loads. As embodied herein and shown in FIGS. 10A–11C, a load building surface 141 is provided for loads which are hand palletized or robot picked. Load building surface 141 may include non-driven rollers, as discussed with respect to the load storage surface 140. The non-driven rollers of the load building surface 141 are preferably capable of being locked into a non-rolling position during load building. That is, when the load 124 is being built, the non-driven rollers of the load building surface 141 do not move, reducing the chance that the load 124 will shift during building. Subsequent to the load building, the non-driven rollers are preferably in an "unlocked" or rolling position. Thus, the rollers are capable of rolling to assist in moving a load off of the load building surface 141. Alternatively, tabs or pins can be used, projecting through the non-driven rollers, to prevent travel of the load as it is being built.

Instead of non-driven rollers, other suitable surfaces, such as smooth, low friction surfaces, may be used for load building surface 141. Load building surface 141 is preferably at the same height as the non-powered conveyor load wrapping surface 130 and, if present, load storage surface 140, in order to facilitate movement of a load between load building surface 141 and wrapping surface 130 and storage surface 140, if present. This may be accomplished by raising load building surface 141 on leveling feet as discussed with respect to the load storage surface, or by any other suitable means. Although depicted with only one load building surface 141, it is possible that two load building surfaces 141 could be used, one on either side of the turntable assembly 120.

Alternatively, both the load building surface 141 and the load storage surface 140 may be areas of the floor adjacent to the load wrapping surface 130. If areas of the floor are used, any configurations discussed with respect to the load building surface 141 and load storage surface(s) 140 are feasible. In such an embodiment, the load building surface 141 and the load storage surface 140 will not be at the same height as the non-powered conveyor load wrapping surface 130. Instead, ramps would be provided on either side of, or on two different sides of, the turntable assembly 120 to provide access to load wrapping surface 130. The gradient of the ramps would be gradual enough to permit the pusher arm 152 of pusher assembly 150 to push a load 124 onto and off of turntable assembly 120.

Figure 10A:
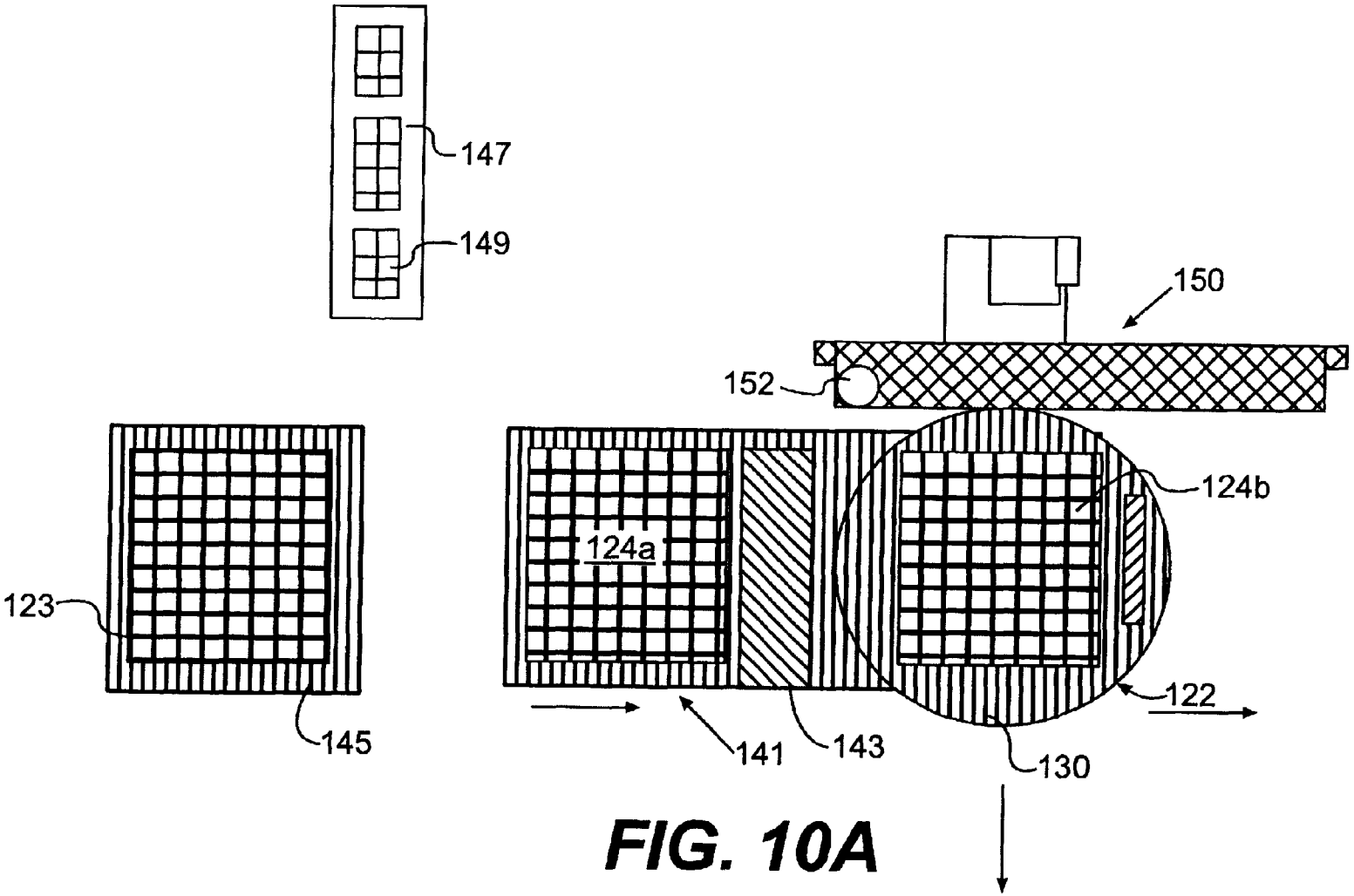
FIGS. 10A–10C are top views of an embodiment of the wrapping apparatus including a hand palletizing surface.
Figure 10B:
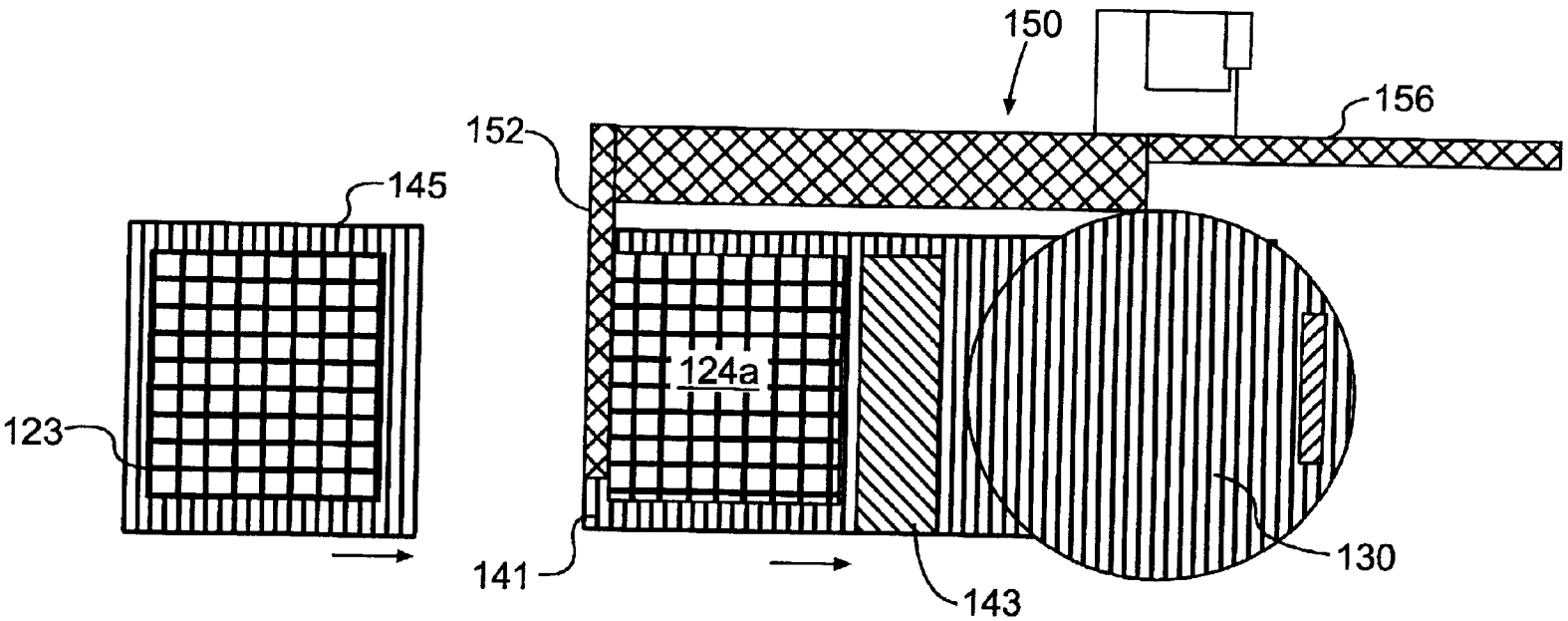
Figure 10C:
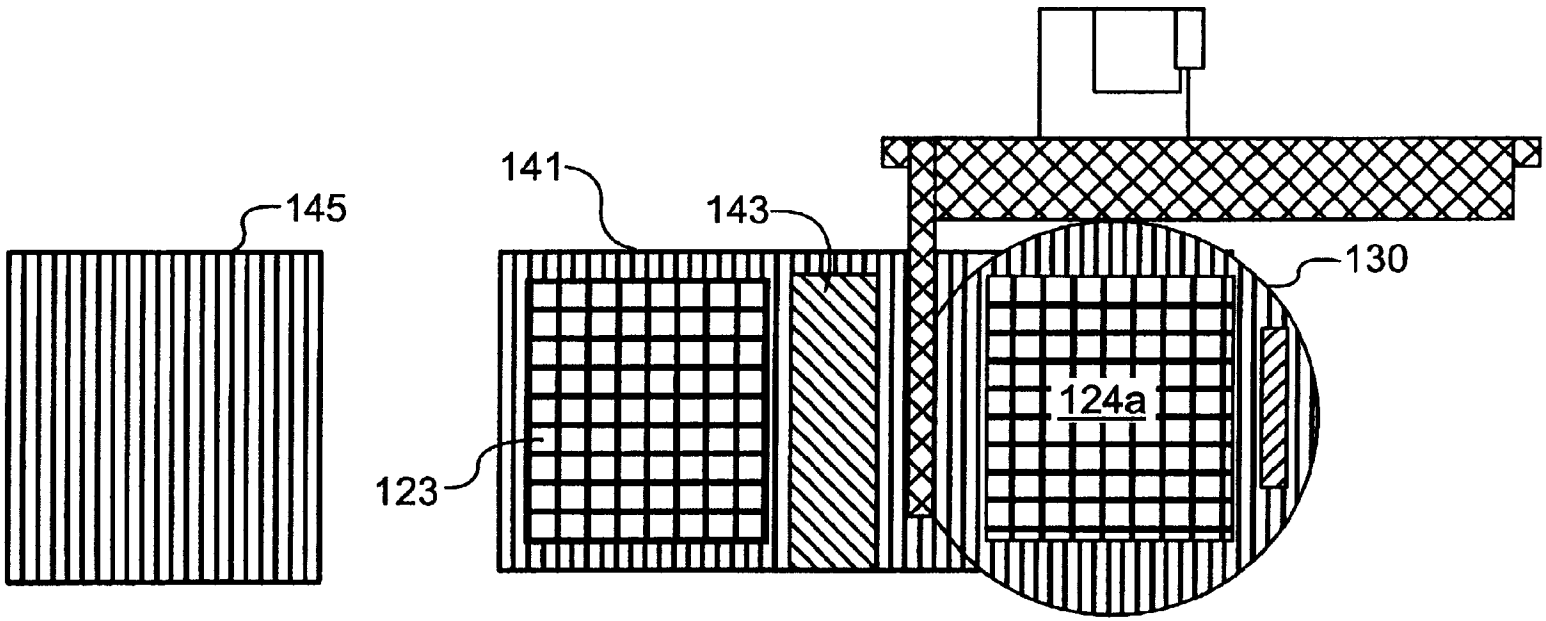
Figure 11A:
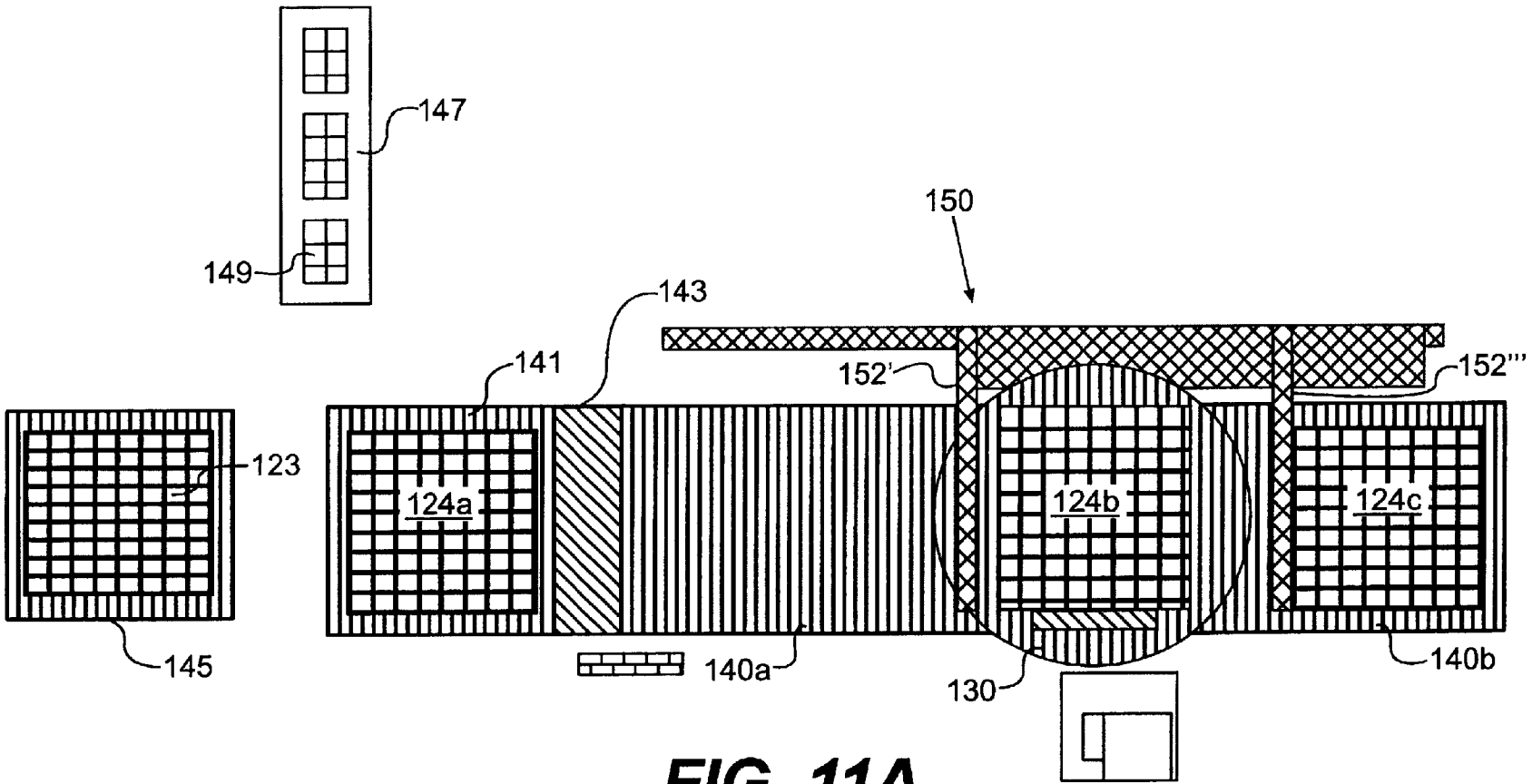
FIGS. 11A–11C are top views of an embodiment of the wrapping apparatus including a hand palletizing surface and a multi-bar pusher assembly.
Figure 11B:
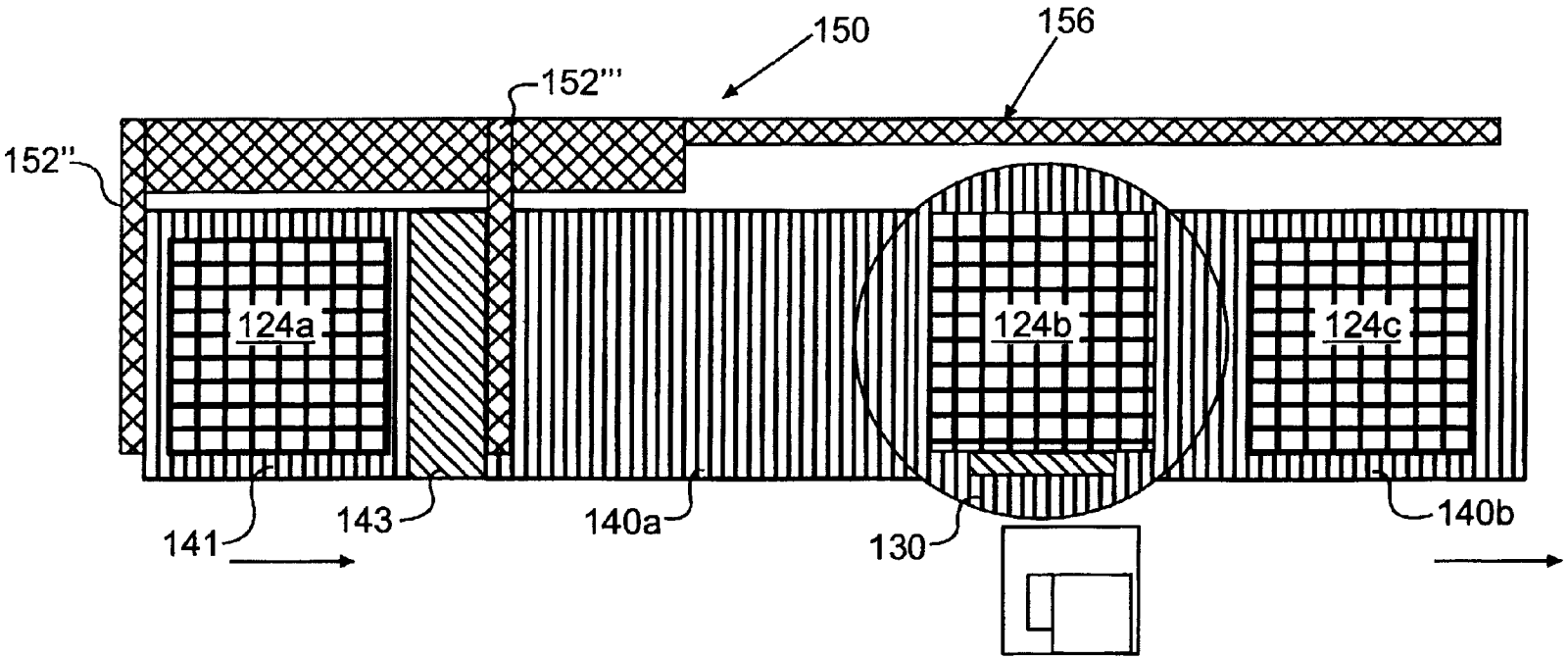
Figure 11C:
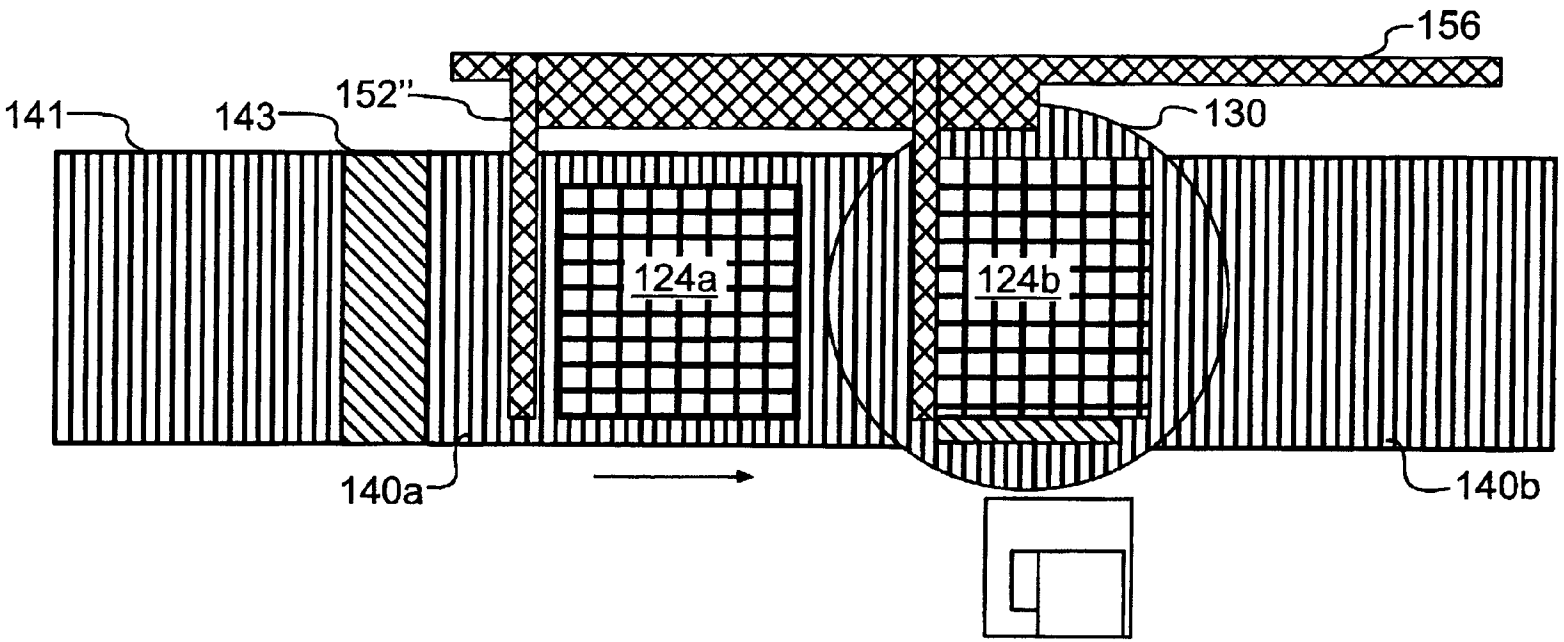

Although load building surface 141 is preferably adjacent to one of the load storage surface 140 and the load wrapping surface 130, it is preferable that a walk plate 143 is provided between the load building surface 141 and either the load wrapping surface 130 or the load storage surface 140, as shown in FIGS. 10A–10C. Walk plate 143 permits a person building the load to walk fully around the hand palletizing area when building the load 124. In order to ensure that sufficient space is provided, it is preferred that the walk plate have a width of approximately 24 inches. However, narrower or wider walk plates may be provided. In addition, it is preferable that the walk plate 143 is flush with the load storage surface 140 or load wrapping surface 130 and the load building surface 141 in order to facilitate movement of the load from the load building surface 141 to either the load storage surface 140 or the load wrapping surface 130.

If a hand palletizing area is provided, as shown in FIGS. 10A–11C, it is preferable that a gravity conveyor 145 or other suitable storage/supply area be provided to supply empty pallets 123. The empty pallets 123 can be moved from the gravity conveyor 145 to the load building surface 141 in the hand palletizing area by a fork truck or other appropriate means.

In such an embodiment, a product infeed conveyor 147 is also provided. Product infeed conveyor 147 supplies products 149 to be palletized in the hand palletizing area. Products 149 are moved from the infeed conveyor 147 by the workers or robots which place them on the load building surface 141 as the load is built.

Figure 8:
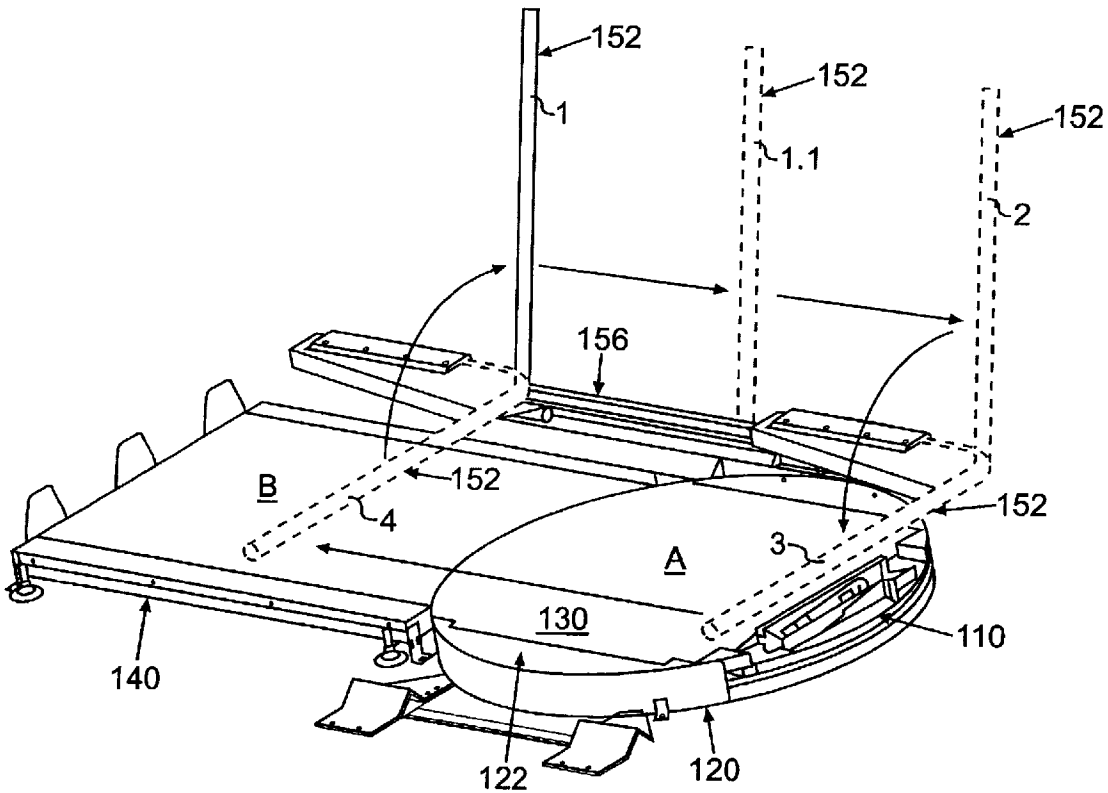
FIG. 8 is an isometric view of the apparatus of FIG. 1 showing the sequence of movement of the pusher assembly.

According to the present invention, and as embodied in FIGS. 1, 2, and 8, a load pusher assembly 150 for moving the load 124 between the load building surface 141, the load wrapping surface 130, and the load storage surface 140 is provided. In a preferred embodiment, the pusher assembly 150 includes a pusher bar or arm 152. Pusher arm 152 is preferably located alongside the load building surface 141, the load storage surface 140, and the load wrapping surface 130, and between these surfaces and the packaging material dispenser 102. In a preferred embodiment, as shown in FIG. 1, a pushing leg 152*a* of the pusher arm 152 fits between the load 124 and the packaging material 116 attached to a clamp or packaging material holder assembly 110 on the rotatable turntable 122. As shown in FIG. 1, pusher arm 152 includes a pusher carrier 154 that rides on a pusher guide 156 and is powered by a pusher drive 158. In a preferred embodiment, the pusher arm 152 is a rotating bar mounted to a linear bearing. The pusher arm 152 has a first travel position where the arm is upright and vertical, and a second pushing position adjacent to the turntable 120 such that the arm is lowered and horizontal.

Figure 7A:
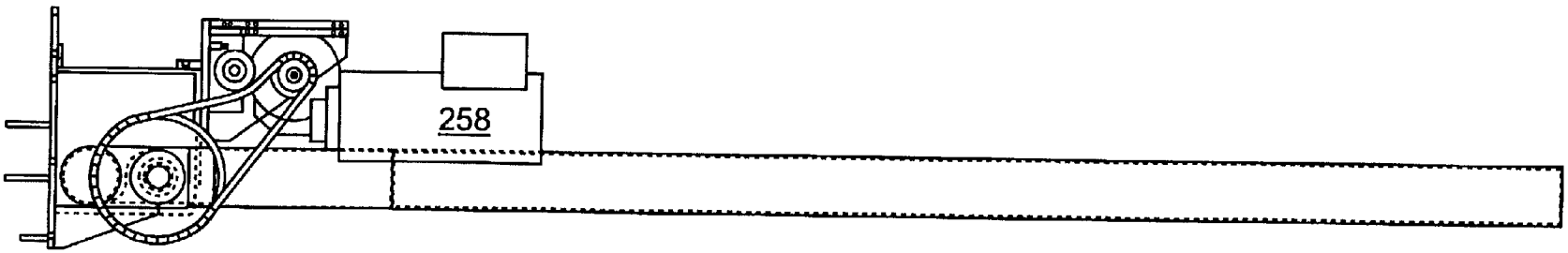
FIG. 7A is a front cross-sectional view of one embodiment of the pusher assembly according to the present invention.
Figure 7B:
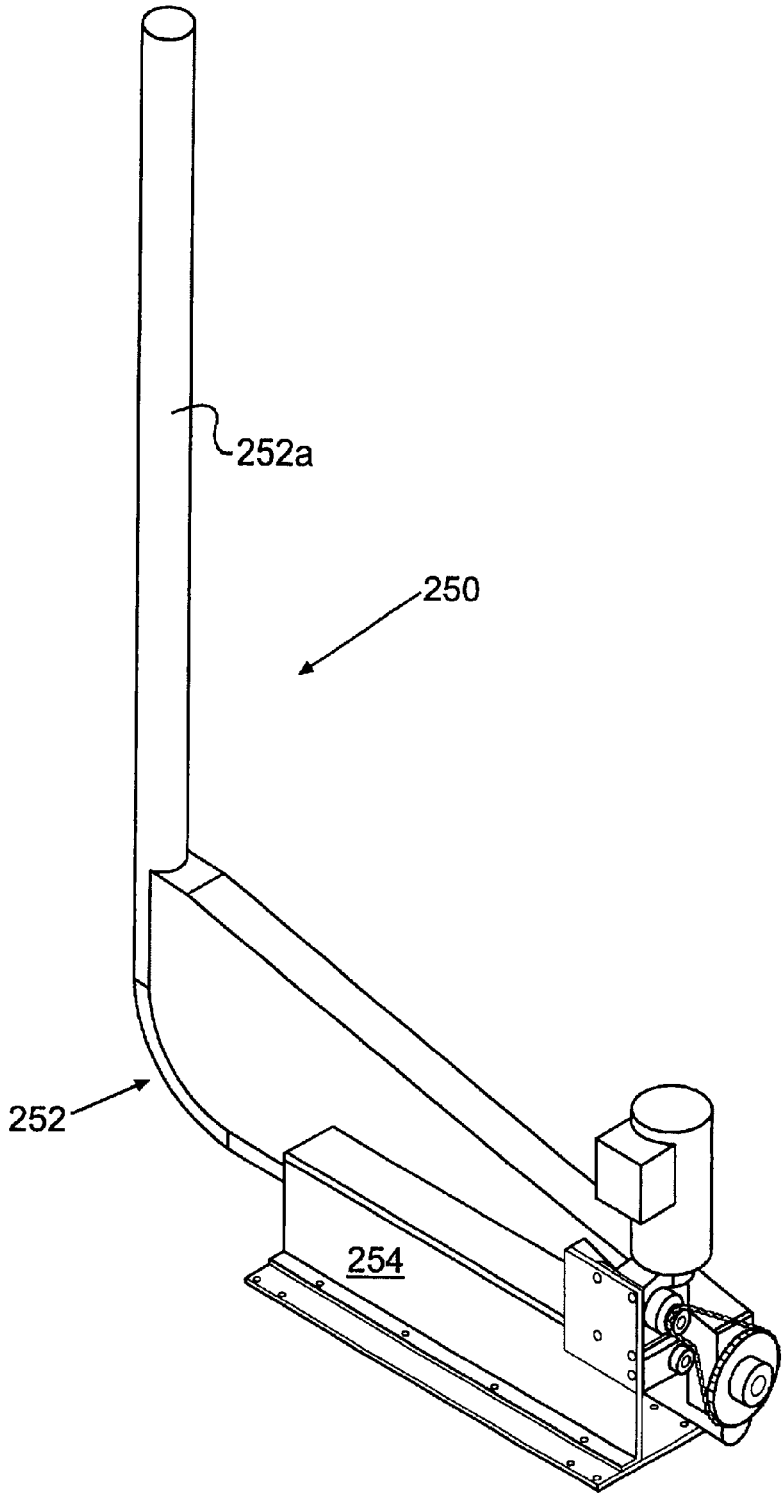
FIG. 7B is an isometric view of the pusher assembly of FIG. 7A.

Alternatively, as shown in FIGS. 7A and 7B, a motor 258 with integrated gear box may be attached to pusher carrier 254 to drive pusher arm 252 along pusher guide 256. In such an embodiment, motor 258 drives rotation of the pusher arm 252 about a center of rotation as determined by the carrier frame 254. Thus, pusher arm 252 is moveable between an upright "home" position and a horizontal pushing position.

Figure 3:
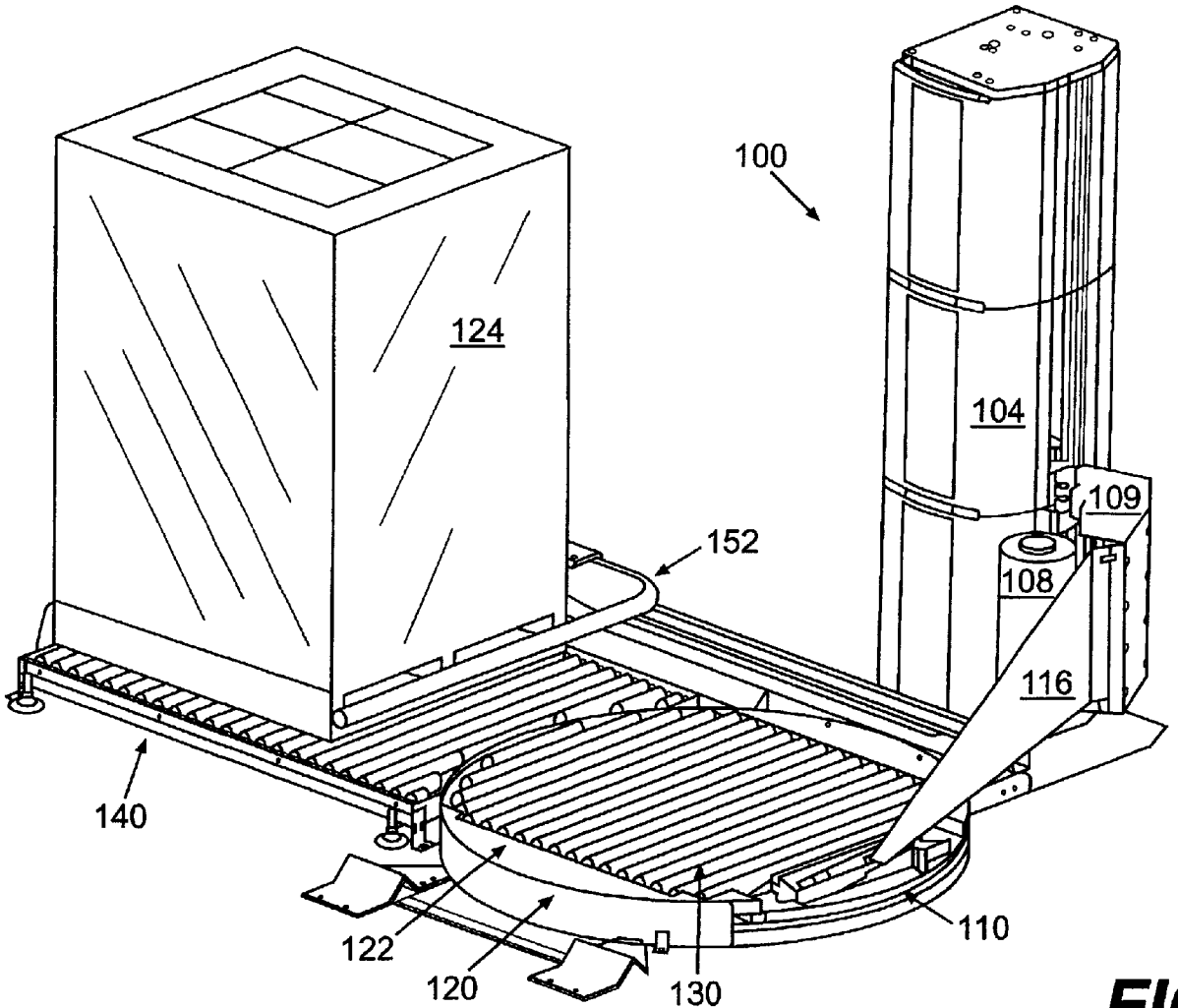
FIG. 3 is an isometric view of the apparatus of FIG. 1 with a wrapped palletized load in the storage position.
Figure 4:
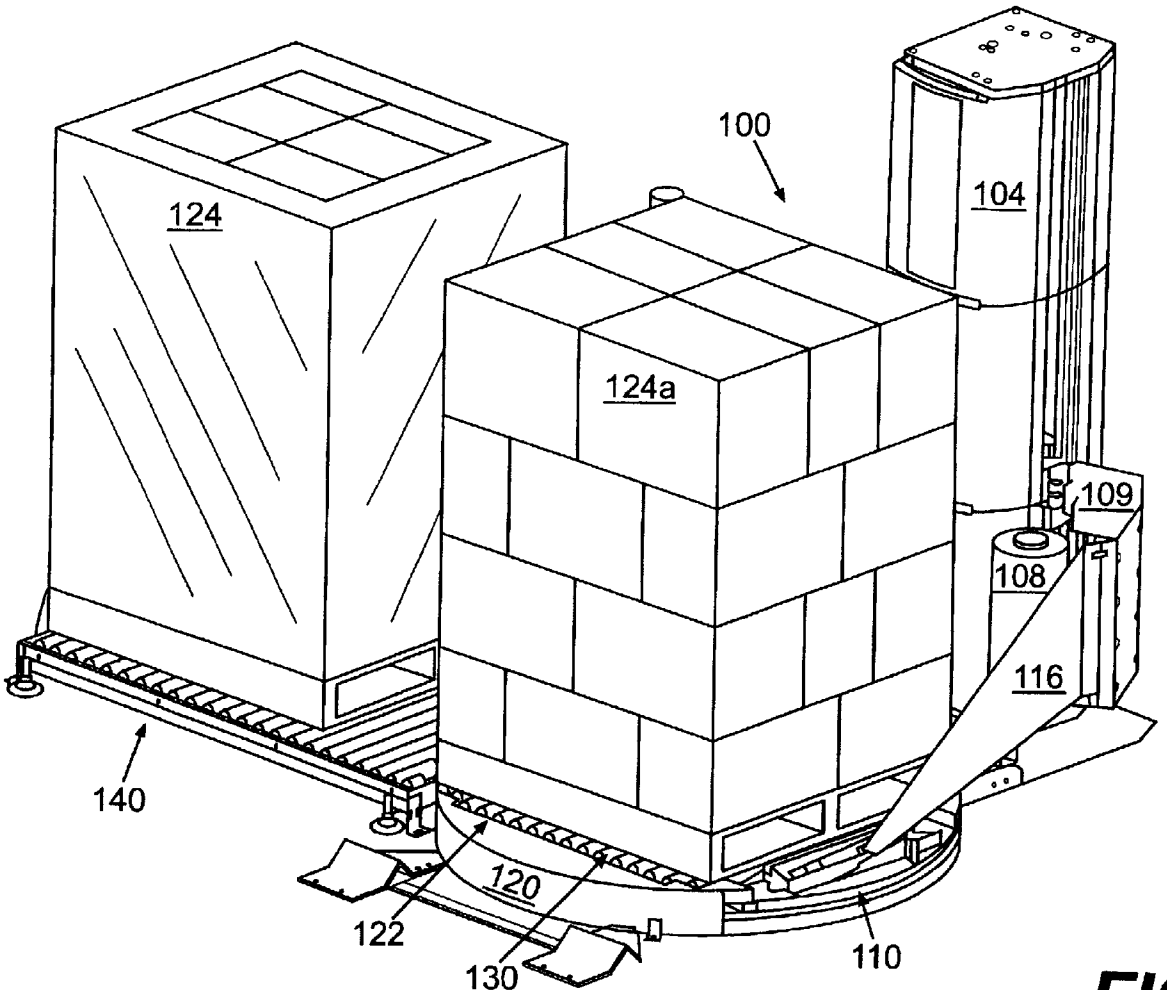
FIG. 4 is an isometric view of the apparatus of FIG. 1 with an unwrapped palletized load on the wrapping surface and a wrapped load on the storage surface.

Referring to FIGS. 1 and 8, pusher arm 152 preferably has an "L" shape, and is configured such that one guiding leg 152*b* of the "L" moves along pusher guide 156, pusher guide 156 forming a track for pusher carrier 154 which carries pusher arm 152 and moves it along guide 156. Another pushing leg 152*a* of pusher arm 152 extends across the load building surface 141, load storage surface 140, and load wrapping surface 130 when in the pushing position, i.e., horizontal and lowered position, see FIGS. 1, 3, and 11A. In a preferred embodiment, the pushing leg 152*a* is of a length greater than or equal to the width of the load 124 to be pushed, as shown in FIGS. 2 and 3. However, it is possible to reduce the length of the pushing leg 152*a* while still moving the load 124 in the desired manner. Pusher arm 152 may be made of any material of sufficient strength and rigidity to move loads, such as steel. In addition, when more than one load storage surface 140*a*, 140*b* is used, as shown in FIG. 9C, it may be desirable or necessary, dependent upon the configuration of the storage surfaces, to use more than one pusher arm 152", 152'", to move the load 124 between the surfaces. In such a case, as shown in FIG. 9C, it is desirable to provide one rotatable pusher arm 152", and one non-rotatable or fixed pusher arm 152'". Such a configuration/use of two or more pusher arms would be desirable, when, as shown in FIGS. 9B and 11A–11C, two load storage areas 140*a*, 140*b*, or both a load building area 141 and a load storage area 140 are provided. When two or more pusher arms 152", 152'" are used, it is desirable to link them to one another such that they act in concert.

Figure 5:
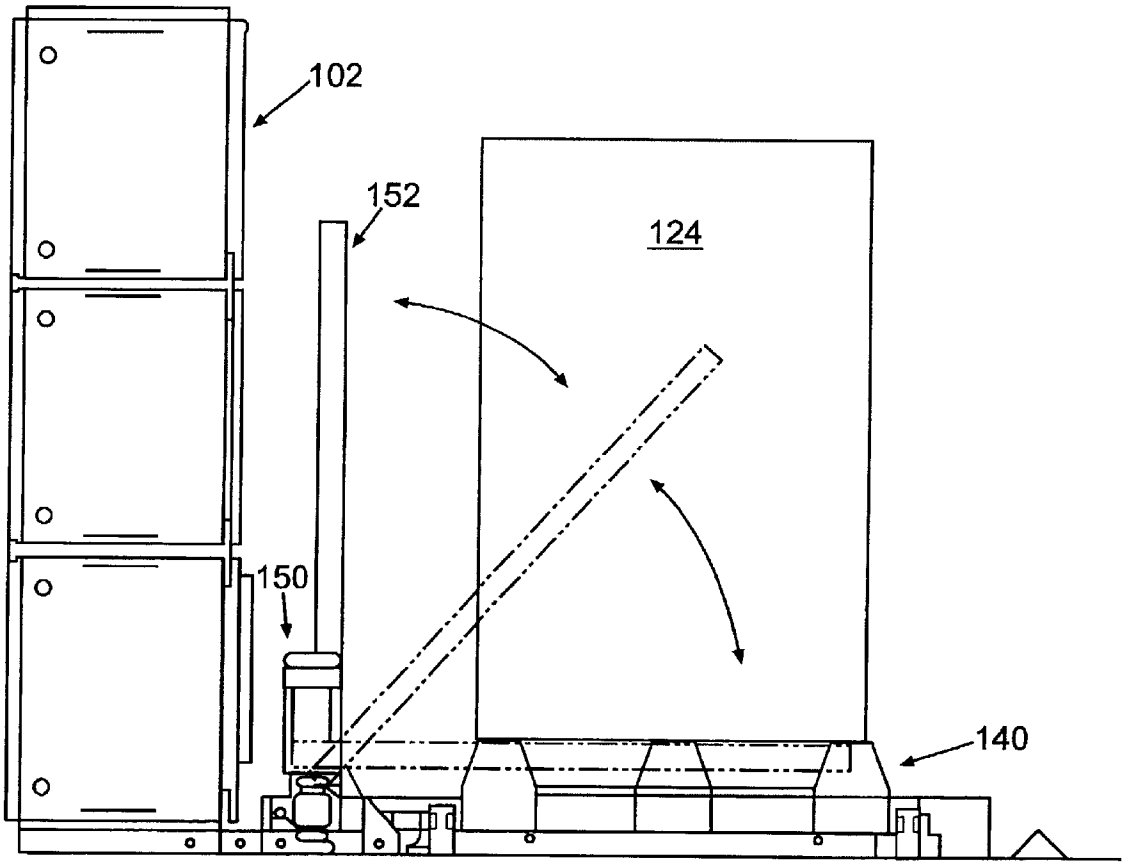
FIG. 5 is a side view of the apparatus of FIG. 3.
Figure 6:
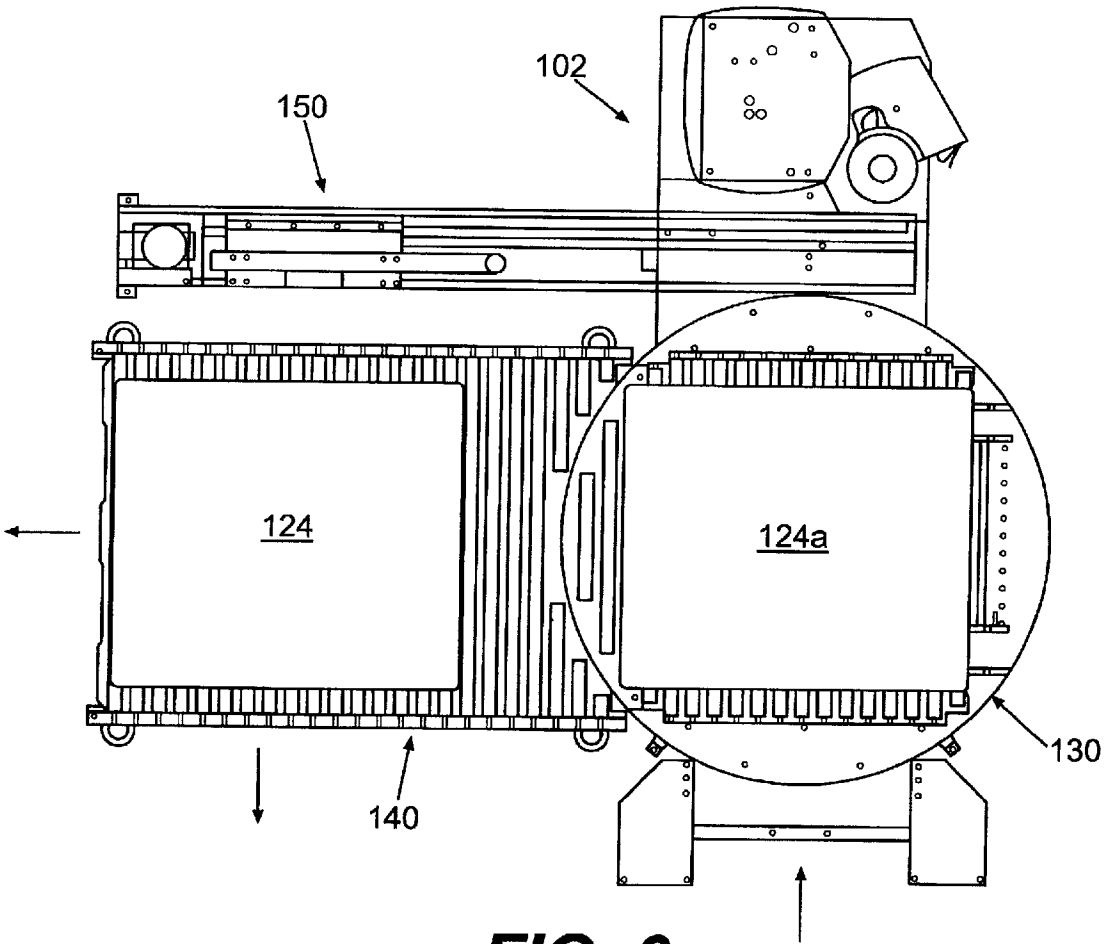
FIG. 6 is a top view of the apparatus of FIG. 4.

Pusher arm 152 is moveable between an upright, vertical position, see FIGS. 5 and 8, and a lowered horizontal pushing position. Pusher arm 152 preferably remains in the upright position unless engaging and moving a load between surfaces, for example, between a load storage surface 140 and the load wrapping surface 130, or between the load building surface 141 and a load storage surface 140 or the load wrapping surface 130. Pusher arm 152 can be used to move the load from the load building surface 141 to the load wrapping surface 130, from the load building surface 141 to a load storage surface 140, from the wrapping surface 130 to a storage surface 140, or from the storage surface 140 to the wrapping surface 130. In some instances, it may be desirable to use the pusher arm 152 to move the load from the storage surface 140 to the wrapping surface 130 and then back to the storage surface 140.

As shown in FIG. 8, pusher arm 152 remains in an upright, vertical position near a downstream end of pusher guide 156 during the wrapping cycle while a load is being wrapped on the non-powered conveyor load wrapping surface 130 of rotatable turntable 122. During the last rotation of the wrapping cycle, pusher arm 152 moves along pusher guide 156 in an upstream direction from position 1 ("home position") to position 2. When pusher arm 152 reaches position 2, a position slightly beyond the end of the load being wrapped, pusher arm 152 rotates approximately 90 degrees, into the lowered horizontal pushing position 3 ("pushing position"). Pusher arm 152 then begins to move in the opposite direction (downstream) along pusher guide 156 while in the lowered horizontal pushing position. Thus, as shown in FIG. 8, pusher arm 152 moves from position 3 to position 4 while still at an angle approximately 90 degrees from the upright position. As pusher arm 152 moves from position 3 to position 4, it engages the load 124 on the non-powered conveyor load wrapping surface 130 and pushes the load 124 from the non-powered conveyor load wrapping surface 130 onto the non-driven conveyor load storage surface 140. This process sequence can be control by simple logic programming. In addition, it is preferable to provide signal or flag to determine whether there is a load already on the non-driven conveyor load storage surface 140. If there is a load on the non-driven conveyor load storage surface 140, the pusher arm 152 will not move a load off of the load wrapping surface 130.

Alternatively, as shown in FIGS. 9A and 10A–10C, it is possible to use the pusher arm 152' to move the load 124 from the load storage surface 140*a* or the load building surface 141 to the load wrapping surface 130*a*. In such a case, the arm 152' would not move the load 124 if another load is present on the wrapping surface 130*a*. In addition, as shown in FIGS. 9B and 11A–11C, in an embodiment where storage surfaces 140*a*, 140*b* or a load building surface 141 and load storage surfaces 140*a*, 140*b* are provided on either side of turntable 120, a pusher guide 156*a* extending along the length of the apparatus may be provided such that the pusher arm 152" can move a load from a first load storage surface 140*b* to the wrapping surface 130*a* and move a wrapped load from the load wrapping surface 130*a* to a second storage surface 140*a*. If desired, more than one pusher arm 152", 152'" may be used. These pusher arms 152", 152'" may or may not be linked to move together. In addition, as shown in FIGS. 9B and 9C, it may be desirable to provide one rotatable pusher arm 152" and one non-rotatable or fixed pusher arm 152'".

A fork truck or other means, such as a pallet jack (a hand operated load moving device), may be used to initially provide a load to be wrapped to the apparatus, either to a load storage surface 140 or to the load wrapping surface 130. In addition, a fork truck or other device, such has a pallet jack, may be used to finally remove the wrapped load from either a load storage surface 140 or the load wrapping surface 130. As shown in FIG. 1, a fork truck bumper 126 may be provided adjacent to the turntable assembly 120 having the load wrapping surface 130. Alternatively, such a bumper may be provided at any other location where a fork truck may be used to deliver/remove a palletized load.

A method of wrapping a palletized load using the wrapping apparatus of the present invention will now be described. As embodied herein and shown in FIGS. 1–4 and 8, a palletized load 124 to be wrapped is placed on non-powered conveyor load wrapping surface 130. The load 124 may be placed on the load wrapping surface 130 by conventional means, such as a fork truck, by a pallet jack (a hand operated load moving device), or by pushing the load 124 onto the load wrapping surface 130 from a load storage surface 140.

If a hand palletizing area is provided for building loads, an empty pallet 123 is moved from the gravity conveyor 145 to the load building surface 141 by a fork truck or other means. Products 149 are removed from infeed conveyor 147 and are stacked on the pallet 123 on the load building surface 141 to form a load 124. Load 124 is then moved by pusher arm assembly, onto either a load storage surface 140 or the load wrapping surface 130. After the load 124 is moved, building of a new load 124*a* commences.

Once the load 124 is positioned on the load wrapping surface 130, relative rotation is provided between the load 124 and the dispenser 102 by rotating rotatable turntable 122. As turntable 122 rotates, packaging material 116 is wrapped around the sides of the load 124.

During the last rotation of the wrapping cycle, pusher arm 152 moves along pusher guide 156 in an upstream direction from position 1 ("home position") to position 2. When pusher arm 152 reaches position 2, a position slightly beyond the end of the load being wrapped, pusher arm 152 rotates approximately 90 degrees, into the horizontal pushing position 3 ("pushing position"). Pusher arm 152 then begins to move in the opposite direction (downstream) along pusher guide 156 while in the horizontal pushing position. Thus, as shown in FIG. 8, pusher arm 152 moves from position 3 to position 4 while still at a 90 degree angle from the upright position. As pusher arm 152 moves from position 3 to position 4, it engages the load 124 on the non-powered conveyor load wrapping surface 130 and pushes the load 124 from the non-powered conveyor load wrapping surface 130 onto the non-driven conveyor load storage surface 140 (FIG. 3).

Once the wrapped load 124 has been moved onto load storage surface 140, a new palletized load 124*a* to be wrapped can be placed on load wrapping surface 130 (FIG. 4) and a new wrapping cycle initiated. Wrapped load 124*a* will not be moved from wrapping surface 130 until the pusher assembly senses that wrapped load 124 has been removed from load storage surface 140. Wrapped load 124 may be removed from load storage surface 140 by conventional means, such as a fork truck 160 or by a pallet jack (a hand operated load moving device).

If more than one load storage surface 140*a*, 140*b* has been provided (FIGS. 9B and 9C), an unwrapped load 124*a* is provided to the first load storage surface 140*b*, pusher arm 152" moves load 124*a* onto the wrapping surface 130*a*, in the same manner as described above with respect to FIG. 8, and wrapping of load 124*a* is initiated. While load 124*a* is being wrapped, a new unwrapped load 124*b* may be placed on first load storage surface 140*b*. Once load 124*a* is wrapped, pusher arm 152" or pusher arm 152" moves load 124*a* onto second storage surface 140*a* to await removal. Unwrapped load 124*b* is moved from the first storage surface 140*b* to the load wrapping surface 130*a*, and a new wrapping cycle is initiated. No load will move between positions unless the position the load is moving to does not already hold a load.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of wrapping a load with packaging material, comprising:

building a load on a load building surface;

pushing the load with a portion of a pusher assembly from the load building surface onto a load wrapping surface of a rotatable turntable, the load wrapping surface being isolated from any electrical or fluid power source by the rotatable turntable;

dispensing packaging material from a packaging material dispenser and rotating the turntable to wrap packaging material around sides of the load; and pushing the wrapped load with a portion of the pusher assembly off of the load wrapping surface onto a load storage surface.

2. The method of claim 1, further comprising building a second load while the first load is being wrapped.

3. The method of claim 1, wherein building the load includes hand palletizing the load.

4. The method of claim 1, wherein pushing the load with a portion of the pusher assembly includes actuating the pusher assembly.

5. The method of claim 4, wherein actuating the pusher assembly includes rotating a pusher arm.

6. The method of claim 5, wherein rotating the pusher arm includes rotating the pusher arm from a vertical upright position to a lowered horizontal position.

7. The method of claim 5, wherein rotating the pusher arm includes rotating the arm approximately 90 degrees from a vertical position to a horizontal position.

8. The method of claim 1, further comprising pushing the load with the pusher assembly onto a load storage surface prior to pushing it onto the load wrapping surface.

9. The method of claim 1, further comprising removing the wrapped load from the load storage surface with a fork truck.

10. The method of claim 1, wherein pushing the load with the pusher assembly includes contacting a side of the load with a pushing element.

11. The method of claim 10, wherein the pushing element is an L-shaped arm.

12. A method of wrapping a palletized load with packaging material, comprising:

placing a palletized load to be wrapped onto a non-powered conveyor load wrapping surface of a rotatable turntable, the non-powered conveyor load wrapping surface being isolated from any electrical or fluid power source by the rotatable turntable;

dispensing packaging material from a packaging material dispenser and rotating the turntable to wrap packaging material around sides of the load; and pushing the wrapped load with a pusher assembly from the non-powered conveyor load wrapping surface of the rotatable turntable to a non-driven conveyor load storage surface adjacent the non-powered wrapping surface, wherein pushing the wrapped load includes rotating a pusher arm of the pusher assembly from an upright position to a horizontal position.

13. The method of claim 12, wherein placing the palletized load includes placing the load with a forklift truck.

14. The method of claim 12, wherein placing the palletized load includes pushing the load with the pusher assembly onto the non-powered conveyor load wrapping surface from the non-driven conveyor load storage surface.

15. The method of claim 12, wherein placing the palletized load includes pushing the load with the pusher assembly onto the non-powered conveyor load wrapping surface from a non-driven conveyor load building surface.

16. The method of claim 12, wherein the rotating includes rotating the pusher arm approximately 90 degrees.

17. The method of claim 12, further comprising building the palletized load on a non-driven conveyor load building surface.

18. The method of claim 17, wherein placing the palletized load includes pushing the palletized load with the pusher assembly onto the load storage surface from the load building surface.

19. The method of claim 18, wherein placing the palletized load further includes pushing the palletized load with the pusher assembly onto the load wrapping surface from the load storage

20. The method of claim 18, wherein pushing the load includes engaging a side of the load with a portion of a pusher assembly.

21. The method of claim 20, wherein pushing the load includes engaging the side of the load with a pusher arm of the pusher assembly. surface.

22. The method of claim 17, wherein building the palletized load includes hand palletizing the load.

23. The method of claim 17, wherein building the palletized load includes using a robot to order pick the load.

24. The method of claim 12, wherein pushing the wrapped load includes engaging a side of the load with a portion of the pusher assembly.

25. The method of claim 24, wherein pushing the load includes engaging a side of the load with a pusher arm of the pusher assembly.

26. The method of claim 24, wherein pushing the load includes moving a pusher arm on a pusher guide.

27. A method of wrapping a palletized load with packaging material, comprising:

building a palletized load to be wrapped on a non-driven conveyor load building surface;

pushing the load with a pusher assembly from the non-driven conveyor load building surface to a non-powered conveyor load wrapping surface of a rotatable turntable, wherein pushing the wrapped load with the pusher assembly includes rotating a pusher arm of the pusher assembly from an upright position to a horizontal position and the non-powered conveyor load wrapping surface is isolated from any electrical or fluid power source by the rotatable turntable;

dispensing packaging material from a packaging material dispenser and rotating the turntable to wrap packaging material around sides of the load; and removing the wrapped load from the non-powered conveyor load wrapping surface.

28. The method of claim 27, wherein removing the wrapped load includes pushing the load with the pusher assembly from the non-powered conveyor load wrapping surface onto a non-driven conveyor load storage surface.

29. The method of claim 28, wherein removing the wrapped load includes using a forklift truck to remove the wrapped load from the non-powered conveyor load wrapping surface.

30. The method of claim 27, wherein pushing the load with the pusher assembly includes first pushing the load from the non-powered conveyor load building surface onto a non-driven conveyor load storage surface and then onto the load wrapping surface.

31. The method of claim 27, wherein the rotating includes rotating the pusher arm approximately 90 degrees.

32. An apparatus for wrapping a load with packaging material, comprising:

a dispenser for dispensing packaging material;

a rotatable turntable for providing relative rotation between the dispenser and the load to wrap packaging material around the load;

a non-powered load wrapping surface on the rotatable turntable being isolated from any electrical or fluid power source by the rotatable turntable;

at least one non-powered load storage surface for storing the load during at least one of prior to and subsequent to wrapping of the load; and a pusher assembly for moving the load between the non-powered load wrapping surface and the at least one non-powered load storage surface, wherein the pusher assembly includes an L-shaped pusher arm that is rotatable between an upright, vertical position and a lowered horizontal position.

33. The apparatus of claim 32, further comprising at least one non-powered load building surface for building loads prior to wrapping.

34. The apparatus of claim 33, wherein the non-powered load building surface is a non-powered conveyor surface.

35. The apparatus of claim 33, wherein the non-powered load building surface is located at a first end of the non-powered load wrapping surface and the non-powered load storage surface is located at an opposite end of the non-powered load wrapping surface.

36. The apparatus of claim 33, further comprising a second non-powered load storage surface.

37. The apparatus of claim 36, wherein one of the non-powered load storage surfaces is located between the non-powered load building surface and a first end of the non-powered load wrapping surface and the other non-powered load storage surface is located at an opposite end of the non-powered load wrapping surface.

38. The apparatus of claim 37, further comprising a second non-powered load building surface.

39. The apparatus of claim 32, wherein the non-powered load wrapping surface is a non-powered conveyor surface.

40. The apparatus of claim 32, wherein the at least one non-powered load storage surface is a non-powered conveyor surface.

41. The apparatus of claim 32, further comprising a second non-powered load storage surface.

42. The apparatus of claim 41, wherein one non-powered load storage surface is located at a first end of the non-powered load wrapping surface and the second non-powered load storage surface is located at an opposite end of the non-powered load wrapping surface.

43. The apparatus of claim 32, wherein the upright, vertical position is a home position and the lowered horizontal position is the pushing position.

44. The apparatus of claim 32, wherein the pusher arm is configured to rotate approximately 90 degrees between the upright vertical position and the lowered horizontal position.

45. The apparatus of claim 32, wherein the pusher assembly further includes a guide for guiding the pusher arm.

46. The apparatus of claim 32, wherein the pusher assembly further includes a second pusher arm.

47. The apparatus of claim 46, wherein the pusher arms are linked to move together.

48. An apparatus for wrapping a palletized load with packaging material, comprising:

a dispenser for dispensing packaging material;

a rotatable turntable for providing relative rotation between the dispenser and the load to wrap packaging material around the load;

a non-powered conveyor load wrapping surface on the rotatable turntable being isolated from any electrical or fluid power source by the rotatable turntable;

at least one non-powered conveyor load storage surface for storing the load prior and subsequent to wrapping; and a pusher assembly for pushing the load between the non-powered conveyor load wrapping surface and the at least one non-powered conveyor load storage surface, wherein the pusher assembly includes an L-shaped pusher arm that is rotatable between an upright, vertical position and a lowered horizontal position.

49. The apparatus of claim 48, further comprising a second non-powered conveyor load storage surface.

50. The apparatus of claim 49, wherein one non-powered conveyor load storage surface is located at a first end of the non-powered conveyor load wrapping surface and the second non-powered conveyor load storage surface is located at an opposite end of the non-powered conveyor load wrapping surface.

51. The apparatus of claim 48, further comprising a non-powered conveyor load building surface.

52. The apparatus of claim 51, wherein the non-powered conveyor load building surface is located at a first end of the non-powered conveyor load wrapping surface and the non-powered conveyor load storage surface is located at an opposite end of the non-powered conveyor load wrapping surface.

53. The apparatus of claim 51, further comprising a second non-powered conveyor load storage surface.

54. The apparatus of claim 53, wherein one of the non-powered conveyor load storage surfaces is located between the non-powered conveyor load building surface and a first end of the non-powered conveyor load wrapping surface and the other non-powered conveyor load storage surface is located at an opposite end of the non-powered conveyor load wrapping surface.

55. The apparatus of claim 48, wherein the upright, vertical position is a home position and the lowered horizontal position is the pushing position.

56. The apparatus of claim 48, wherein the pusher arm is configured to rotate approximately 90 degrees between the upright, vertical position and the lowered horizontal position.

57. The apparatus of claim 48, wherein the pusher assembly further includes a guide for guiding the pusher arm.

58. The apparatus of claim 48, wherein the pusher assembly further includes a second pusher arm.

59. The apparatus of claim 48, wherein the pusher arms are linked to move together.

* * * * *

UNITED STATES PATENT AND TRADEMARK OFFICE

CERTIFICATE OF CORRECTION

PATENT NO. : 7,137,233 B2
APPLICATION NO. : 09/985156
DATED : November 21, 2006
INVENTOR(S) : Patrick R. Lancaster, III et al.

It is certified that error appears in the above-identified patent and that said Letters Patent is hereby corrected as shown below:

On Title Page, Item (75) the order of inventors should be changed so that the first listed inventor reads --Patrick R. Lancaster, III--;

Claim 20, col. 10, lines 47 and 48, "a pusher assembly" should read --the pusher assembly--; and Claim 21, col. 10, line 51, delete period after "assembly."

Signed and Sealed this

Seventeenth Day of April, 2007

JON W. DUDAS
*Director of the United States Patent and Trademark Office*